US008943624B1

(12) United States Patent
Youngstrom

(10) Patent No.: US 8,943,624 B1
(45) Date of Patent: Feb. 3, 2015

(54) CAPTAINS BED HAVING INTEGRATED SHELVING AND SLIDEOUT FEATURES

(71) Applicant: Gary Youngstrom, Winlock, WA (US)

(72) Inventor: Gary Youngstrom, Winlock, WA (US)

( * ) Notice: Subject to any disclaimer, the term of this patent is extended or adjusted under 35 U.S.C. 154(b) by 0 days.

(21) Appl. No.: 14/098,872

(22) Filed: Dec. 6, 2013

(51) Int. Cl.
*A47C 19/00* (2006.01)
*A47C 19/22* (2006.01)

(52) U.S. Cl.
CPC ..... *A47C 19/22* (2013.01)
USPC ..... 5/131; 5/58; 5/308; 5/2.1; 5/282.1

(58) Field of Classification Search
CPC ..... A47C 19/22
USPC ..... 5/58, 308, 2.1, 280, 282.1, 285, 400, 5/131, 132, 93.2, 678–679; 312/330.1, 312/194, 195
See application file for complete search history.

(56) References Cited

U.S. PATENT DOCUMENTS

| | | | | | |
|---|---|---|---|---|---|
| 1,930,882 | A | * | 10/1933 | McRae | 108/49 |
| 2,462,524 | A | * | 2/1949 | Mattedi | 5/308 |
| 2,570,609 | A | * | 10/1951 | Taylor, Jr. | 5/3 |
| 2,787,007 | A | * | 4/1957 | Erdkamp | 5/2.1 |
| 4,109,328 | A | * | 8/1978 | Mason | 5/2.1 |
| 4,259,755 | A | * | 4/1981 | Hollander | 5/58 |
| 4,735,471 | A | * | 4/1988 | Riggsby | 312/312 |
| 5,067,183 | A | * | 11/1991 | Urquiola | 5/2.1 |
| 5,983,420 | A | * | 11/1999 | Tilley | 5/2.1 |

* cited by examiner

*Primary Examiner* — Robert G Santos
*Assistant Examiner* — David E Sosnowski
(74) *Attorney, Agent, or Firm* — Lowe Graham Jones PLLC

(57) ABSTRACT

A bed is disclosed including first and second platform portions, the first including drawers and slideout features that are vertically offset to serve as chairs and a desk. The second platform portion supports a portion of a mattress and a panel for supporting the mattress. The second platform may include vertical supports flush with lateral panels of the first platform portion and may include laterally extending shelves and a horizontal support positioned to support the mattress. The drawers and slideout features may be mounted in modules positioned in rows to define the first platform. A slideout platform may slide out from a foot of the bed and may include a vertical panel that is flush with a back panel of the second platform portion.

15 Claims, 7 Drawing Sheets

CAPTAINS BED HAVING INTEGRATED SHELVING AND SLIDEOUT FEATURES

FIELD OF THE INVENTION

This application relates to captains beds having drawers or other features positioned under a sleeping platform thereof.

BACKGROUND OF THE INVENTION

As known in the art, captains beds are beds having drawers mounted under the sleeping platform in order to facilitate storage. Also known in the art are loft beds under which other pieces of furniture may be positioned and then slid out for use or used in place. Loft beds are not suitable for all people and applications. In particular, a parent may not be comfortable with a child sleeping at a high elevation for fear of falls.

The bed disclosed herein provides an improved approach for incorporating furniture into a bed.

SUMMARY OF THE INVENTION

In one aspect of the invention, a bed includes a first platform portion defining a longitudinal direction, a lateral direction perpendicular to the lateral direction and a vertical direction perpendicular to the longitudinal and lateral directions. The first platform defines a support area and includes lateral panels extending in a first direction from the support area parallel to the vertical direction, the lateral panels defining panel surfaces parallel to the vertical and longitudinal directions. A second platform portion defines an upper surface, the upper surface being flush with the support area. The second platform includes at least two vertical supports extending in the first direction from the upper surface, the two vertical supports each defining a support surface parallel to and flush with the panel surfaces. At least one shelf extends parallel to the lateral direction between the vertical supports and offset from the upper surface in the first direction. The first and second platform are separate structures and are secured to one another by fasteners.

A platform may extend over the upper surface of the second platform and the support area of the first platform and a mattress may be positioned on the platform cover, the mattress being supported by both the first and second platform portions. The bed may include a headboard and a footboard, the headboard being coupled to the first platform portion and the footboard being coupled to the second platform portion such that the first and second platform portions are positioned between the headboard and the footboard.

In some embodiments, the first platform defines one or more slots having a long dimension thereof oriented in the longitudinal direction, the slots extending inward from one of the lateral panels in the lateral direction. For example, the one or more slots may be a plurality of slots, the plurality of slots including slots at different offsets in the first direction from the support area.

In some embodiments, the first platform defines a plurality of drawer receivers distributed in a row along the longitudinal direction, the plurality of drawer receivers including one or more first receivers having a first height in the longitudinal direction and one or more second receivers having a second height in the longitudinal direction, the second height being less than the second height, the one or more slots being positioned at least one of above and below the second receivers in the vertical direction, the first height of the one or more first receivers spanning in the vertical direction both the one or more second receivers and the one or more slots.

The bed may further include one or more planar members positioned within the one or more slots. Each planar member may have one or more stops secured thereto, the one or more stops being positioned beneath the support area and sized to prevent passage of the stops and planar members completely through the slots. The planar members may each include at least one row of holes distributed in the lateral direction, the one or more stops of the each planar member each comprising a post positionable within a hole of the at one row of holes. In some embodiments, each of the planar members include a lip extending outwardly from the slot having the slot positioned between the lip and the stop of the each planar member.

The first platform member may include a plurality of modules each module defining at least one slot and at least one drawer receiver. For example, each module may include two lateral planar members extending in the vertical and lateral directions, each defining a groove having a planar member of the one or more planar members positioned within the groove. Each module may include a back panel extending in the vertical and longitudinal directions and secured to and extending between the two lateral planar members. In some embodiments, at least one of the modules includes a reinforcing member secured to and extending between the two lateral planar members, the reinforcing member being flush with upper edges of the two lateral planar members and laterally overlapping at least a portion of the grooves of the two lateral planar members. The reinforcing member may abut a back panel extending in the vertical and longitudinal directions and secured to and extending between the two lateral planar members. The modules may be arranged in two rows extending in the longitudinal direction, the two rows defining lateral space therebetween. A platform defining a planar surface extends in the longitudinal and lateral directions and is slidingly mounted between the two rows.

In another aspect of the invention, a bed includes a sleeping platform extending in a longitudinal direction between first and second ends and extending in a lateral direction between right and left sides, the lateral direction being perpendicular to the longitudinal direction. Two lateral panels extend downwardly at the right and left sides of the sleeping platform and extending in the longitudinal direction and a vertical direction perpendicular to the longitudinal and lateral directions. A platform is slidably mounted beneath the sleeping platform. A fixed back panel portion mounted beneath the sleeping platform and defines an opening. A movable back panel portion is mounted to the platform and positionable flush with the fixed back panel portion by sliding of the platform. In some embodiments, the sleeping platform defines a first aperture and the movable back panel portion defines a second aperture alignable with the first aperture by sliding the platform. A fastener is selectively positionable within the first and second apertures.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
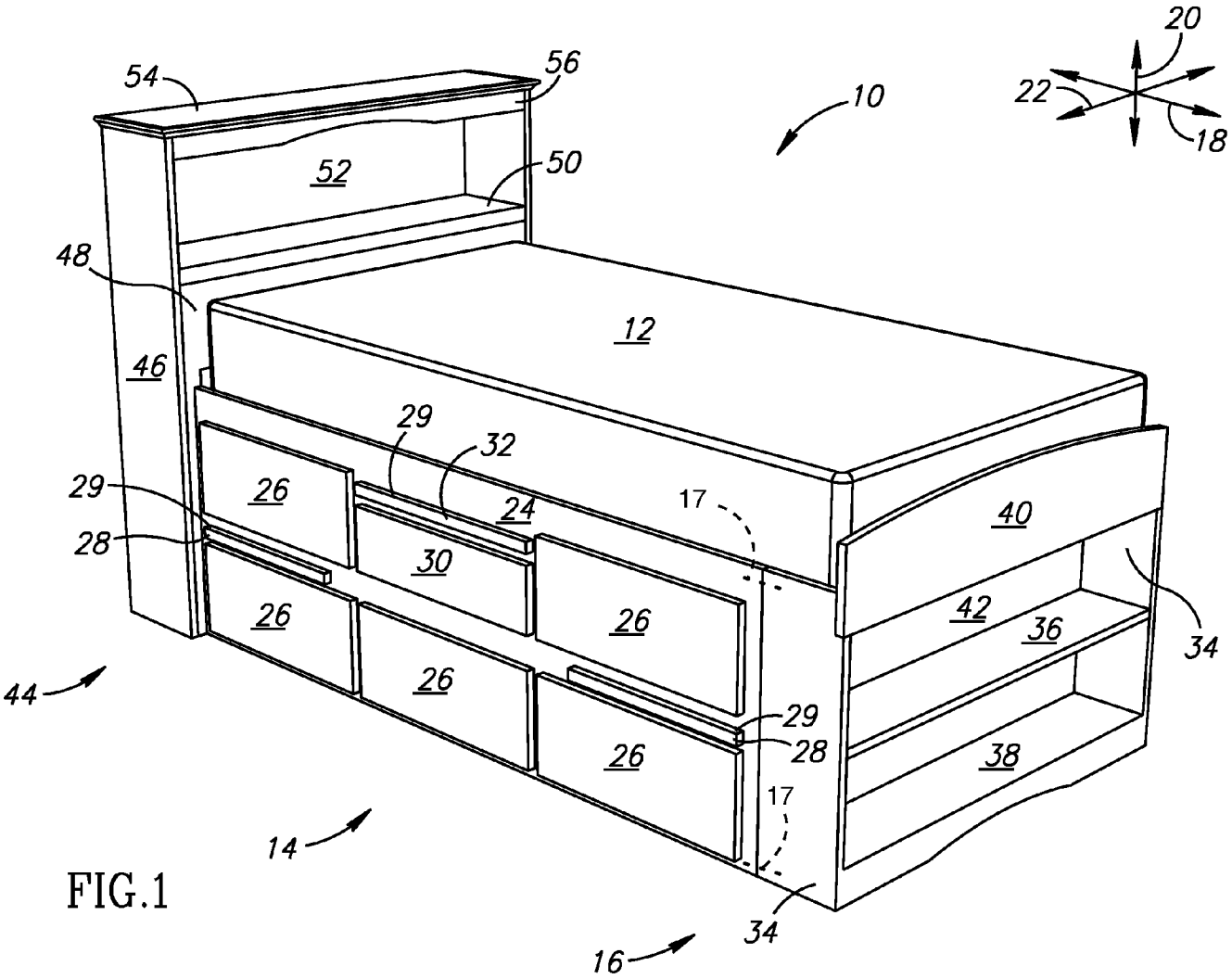
FIG. 1 is an isometric view of a bed in accordance with an embodiment of the present invention.
Figure 2:
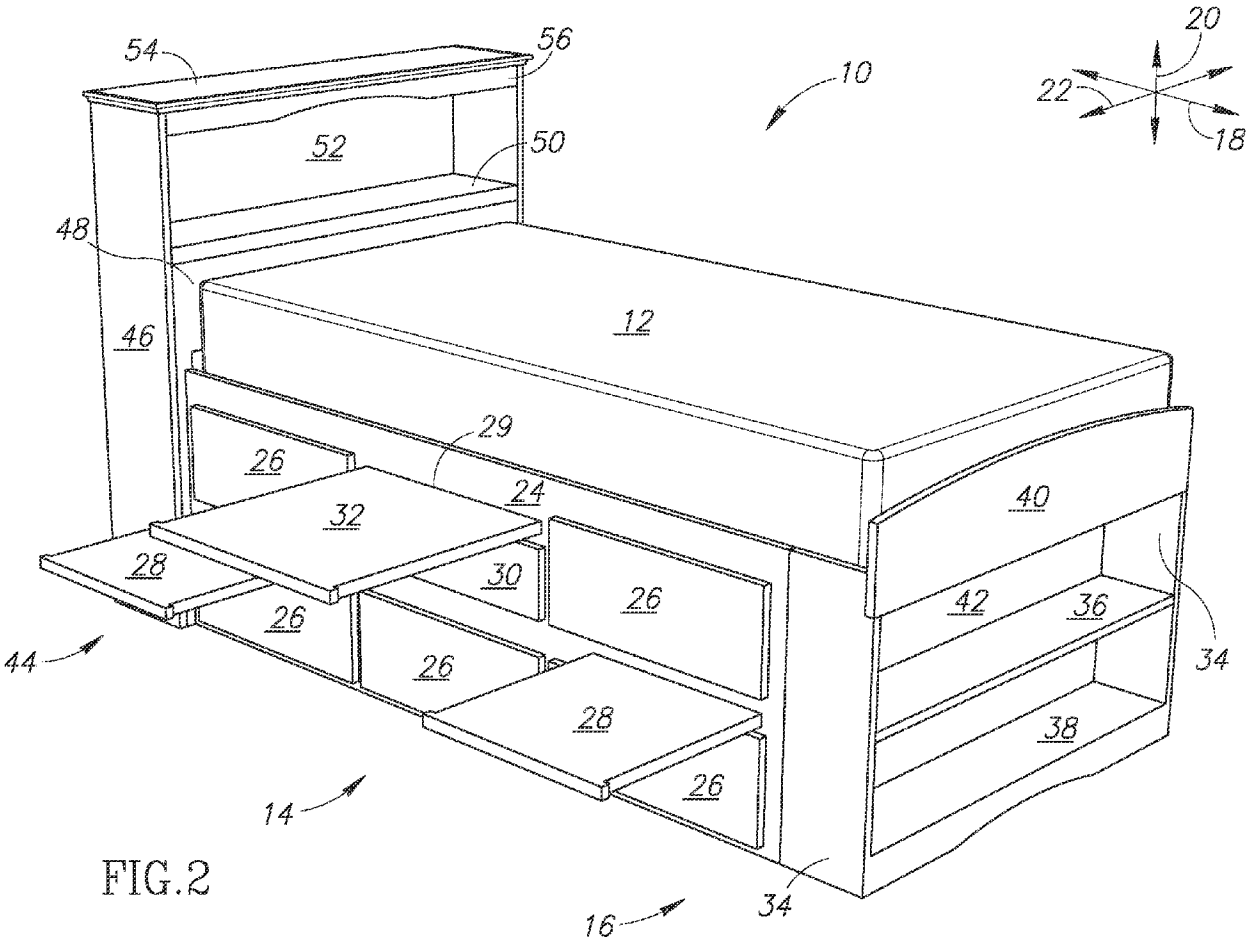
FIG. 2 is an isometric view of the bed of FIG. 1 having slideout features in a deployed configuration.

Referring to FIGS. 1 and 2, a bed 10 may include a mattress 12 supported by a first platform portion 14 and a second platform portion 16 secured to one another by fasteners 17. The bed 10 may be understood with respect to a longitudinal direction 18 that corresponds to the height of a person reclined on the bed. A vertical direction 20 may be defined as perpendicular to the longitudinal direction 18 and parallel to the force of gravity. A lateral direction 22 may be defined as perpendicular to the longitudinal direction 18 and vertical direction 20.

The first platform portion 14 may have an extent in the longitudinal direction 18 that is much larger than that of the second platform portion 16. In particular, the longitudinal extent of the mattress 12 supported by the first platform portion 14 may be much larger than the longitudinal extent of the mattress 12 supported by the second platform 16. For example, in either case "much larger" may imply for 100% of the total longitudinal length of the bed 10 or 100% of the longitudinal extent of the mattress 12 may be divided from 95% for the first platform portion 14 and 5% for the second platform portion 16 to 90% for the first platform portion 14 and 12% for the second platform portion. For example, the first platform portion 14 may have a length in the longitudinal direction 18 of 69 inches whereas the second platform portion 16 has a length of 7.5 inches in the longitudinal direction 18. The first platform portion 14 and second platform portion 16 may be separate pieces that secure to one another only along a vertically and laterally extending boundary therebetween, other than a planar sleeping platform that may rest thereon.

The first platform portion 14 may include a panel 24 extending in the longitudinal and vertical directions 18, 20, such as a rectangular panel 24. The panel 24 may receive drawers such that the faceplates 26 thereof abut the panel 24 when retracted. As shown in FIGS. 1 and 2 the faceplates 26 may be arranged in rows vertically above one another. In some embodiments, one or more pull out features 28 may be disposed vertically between the rows of faceplates 26. Accordingly, the panel 24 may define slots 29 that receive these slideout features 28. The slots 29 may have a length in the longitudinal direction 18 being many times (e.g. more than 12 times) the thickness of the slot in the vertical direction 20. In some embodiments, some or all of the faceplates 26 have a vertical extent whereas one or more faceplates 30 have smaller vertical extent than other faceplates 26 located longitudinally one either side of the faceplate 30. A slideout feature 32 may be disposed vertically above or below the faceplate 30 in a slot 29 such that the combined vertical extent from a top of the slideout feature 32 (or faceplate 30) and the bottom of the faceplate 30 (or slideout feature 32) is less than or equal to the vertical extent of the adjacent faceplates 26. In particular, the slideout feature 32 and faceplate 30 may lie completely within a vertical span occupied by the adjacent faceplates 26.

In the illustrated embodiment, the slideout features 28, 32 are at different vertical positions than the slideout feature 32. In particular, each row of faceplates 26, 30 may include three faceplates 26, 30. The slideout feature 32 is located above a middle faceplate 30 whereas the slideout features 28 are located between faceplates 26 on either side of the middle faceplate 30 and vertically below the slideout feature 32. Accordingly, as shown in FIG. 2, in use the slideout features 28 operate as chairs for a person using the slideout feature 32 as a desk. The slideout feature 32 may have a longitudinal width that is greater than that of the slideout features 28 to provide more useable surface area. As also is apparent in FIG. 2, there may be a longitudinal gap between the slideout features 28 and the slideout feature 32 to facilitate seating of a person onto the slideout features 28.

The opposing side of the bed 12 may have a similar continuous panel 24 having the same vertical and longitudinal extent as shown in FIGS. 1 and 2, either with or without a configuration of drawers and faceplates 26, 30, slideouts 28, 32, etc. For example, an embodiment without any configuration of drawers, faceplates, slideouts, etc. may be appropriate when the bed 12 is to be positioned against a wall. In alternative embodiments, the opposing side of the bed 12 may have either a similar or varying configuration of drawers and faceplates 26, 30, slideouts 28, 32, etc. Again, the configuration of these elements may vary according to the intended position and usage of the bed.

The second platform portion 16 may incorporate shelving, e.g., a book case. The second platform portion 16 may include vertical supports 34 that extend vertically upward from a support surface. As is apparent, both the panel 24 and vertical supports 34 extend vertically downward from the sleeping platform supporting the mattress 12 to define a continuous base for resting on a support surface. One or more shelves 36 extend in the lateral direction between the vertical supports 34. The shelves 36 may be flush with outward facing surfaces of the vertical supports 34 or be offset inwardly from the outward facing surfaces. A base plate 38 or base shelf may also extend between the vertical supports 34. In some embodiments a foot portion or footboard 40 mounts to outer faces of the vertical supports and the mattress 12 may abut the footboard 40. The footboard may be a planar member extending vertically upward from the second platform portion 16 and partially vertically overlap the mattress 12 and provide a stop for holding the mattress 12.

A back panel 42 may extend in the vertical and lateral directions 20, 22 such that the one or more shelves protrude longitudinally outward from the back panel 42. The back panel 42 may be positioned at a boundary between the first platform portion and the second platform portion.

In some embodiments a head portion or headboard 44 abuts the first platform portion 14 such that the first platform 14 portion is longitudinally positioned between the head portion 44 and the second platform portion 16. The headboard 44 may include vertical supports 46. The vertical supports 46 may be laterally offset outwardly from the panel 24 or may be flush in the longitudinal and vertical directions 18, 20 with the panel 14. A panel 48 may extend outwardly from the panel 24 and the support platform defined by the first platform portion 14 and abut the inner surfaces of the vertical supports 46. An upper edge of the panel 46 may abut a shelf 50 extending in the lateral direction above the support surface defined by the first platform portion 14 and offset vertically from the support surface to provide space for the mattress 12 such that the shelf 50 is positioned vertically above an upper surface of the mattress 12. A back panel 52 may extend in the vertical and lateral directions 20, 22 between the vertical supports 46.

In the illustrated embodiments, the vertical supports 46 and back panel 52 extend vertically upward beyond the shelf 50 and a top panel 54 extends over the vertical supports 46 and back panel 52 and secures thereto. The top panel 54 may have decorative molding and may have a decorative panel 56 located at an edge thereof and extending partially downward toward the shelf 50.

Figure 3:
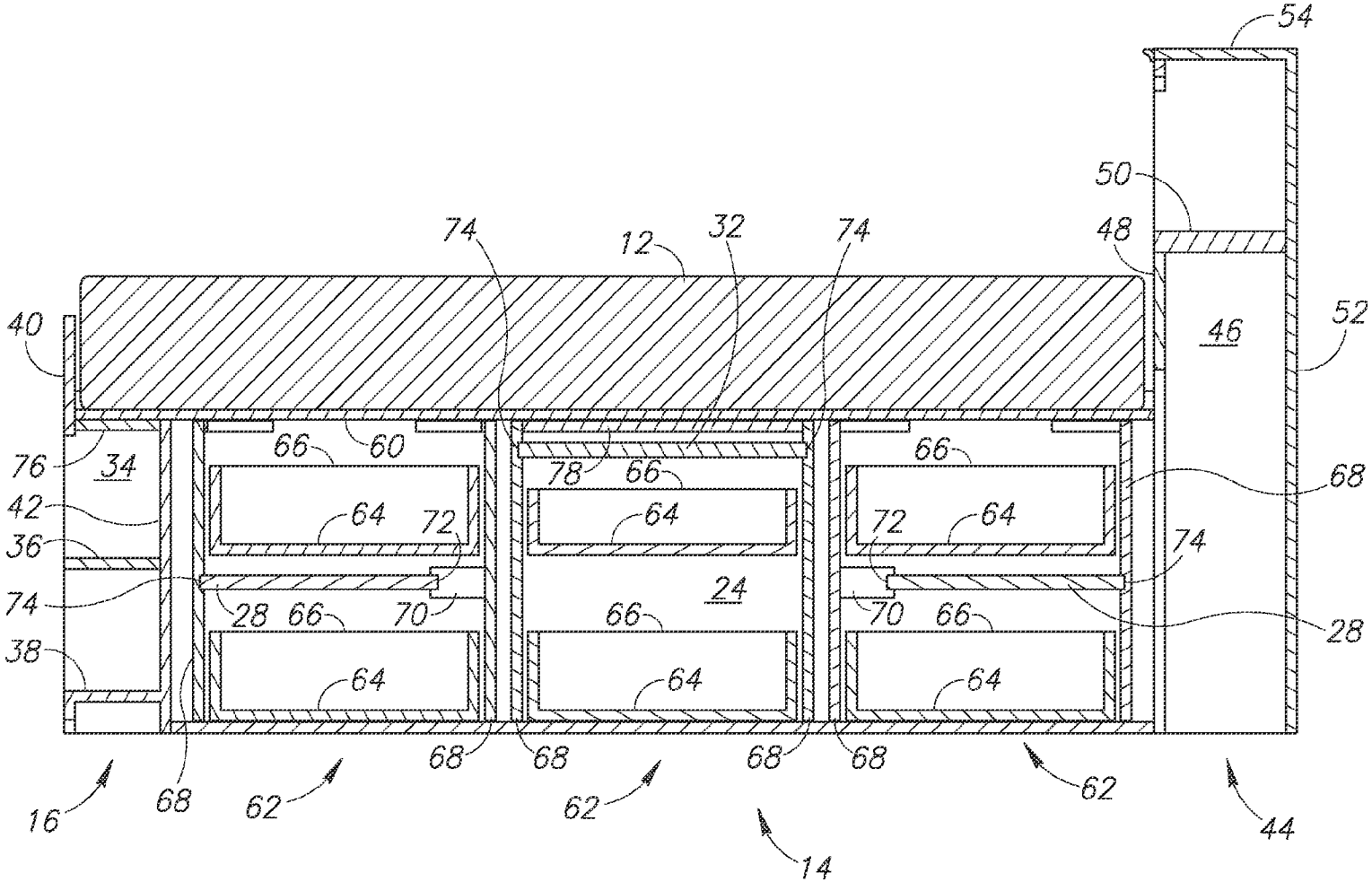
FIG. 3 is a cross-sectional view of the bed of FIG. 1.

Referring to FIG. 3, a support panel 60 may extend in the longitudinal and lateral directions 18, 22. For example, the support panel 60 may extend laterally between the panels 24 and longitudinally between panel 48 and the footboard 40. The support panel 60 may rest on modules 62 that each define receivers for drawers 64 and provide support to the support panel 60. The modules 62 may each include pairs of vertical panels 68 positioned on either side of the drawers 64. Hardware for slidingly mounting drawers (not shown) as known in the art may be interposed between the vertical panels 68 and the drawers. In embodiments where the panels 24 on both sides of the bed 10 have drawers, two longitudinal rows of modules 62 may be used. In other embodiments, only one row of modules 62 are used for supporting drawers accessible through only one of the panels 24. In such embodiments, the vertical panels 68 may extend laterally from one of the panels 24 less than an entire distance, e.g. less than 80%, less than 70%, or less than 50%, to an opposing panel 24.

Edges of slideout features 28, 32 may slidingly engage the vertical panels 68 of a module 62. In some embodiments, a spacer 70 secures to one or both of the vertical panels 68 of a module 62 and define a laterally extending groove 72 for slidingly receiving an edge of a slideout feature 28, 32. Alternatively, one or both of the vertical panel 68 of a module 62 may define laterally extending grooves 74 defined by the panel 68 itself may slidingly receive the slideout features 28, 32. In some instances, one panel has a spacer 70 and groove 72 whereas the opposing panel 68 of the module 62 has a groove 74 formed therein. The grooves 72 and grooves 74 extend along the panels and spacers 70 in the lateral direction 22 (perpendicular to the page). In alternative embodiments, other structures for slidingly mounting structures as known in the art of furniture design may be used, such as metal rails or channels mounted to the opposing panels 68.

Also apparent in FIG. 3 is a panel 76 that extends laterally between the vertical supports 34 and supports the support panel 60. Accordingly, the second platform portion provides a portion of the longitudinal extent of a structure supporting the mattress 12 and the support panel 60.

In some embodiments, a support panel 60 may be thin and somewhat flexible. Although sagging may be acceptable for a person using the bed 10, it may also interfere with sliding of the slideout feature 32 positioned beneath the support panel 60. Accordingly, a reinforcing panel 78 may be positioned over at least a portion of the grooves 74 (or grooves 72) in which the slideout feature 32 is mounted.

Figure 4:
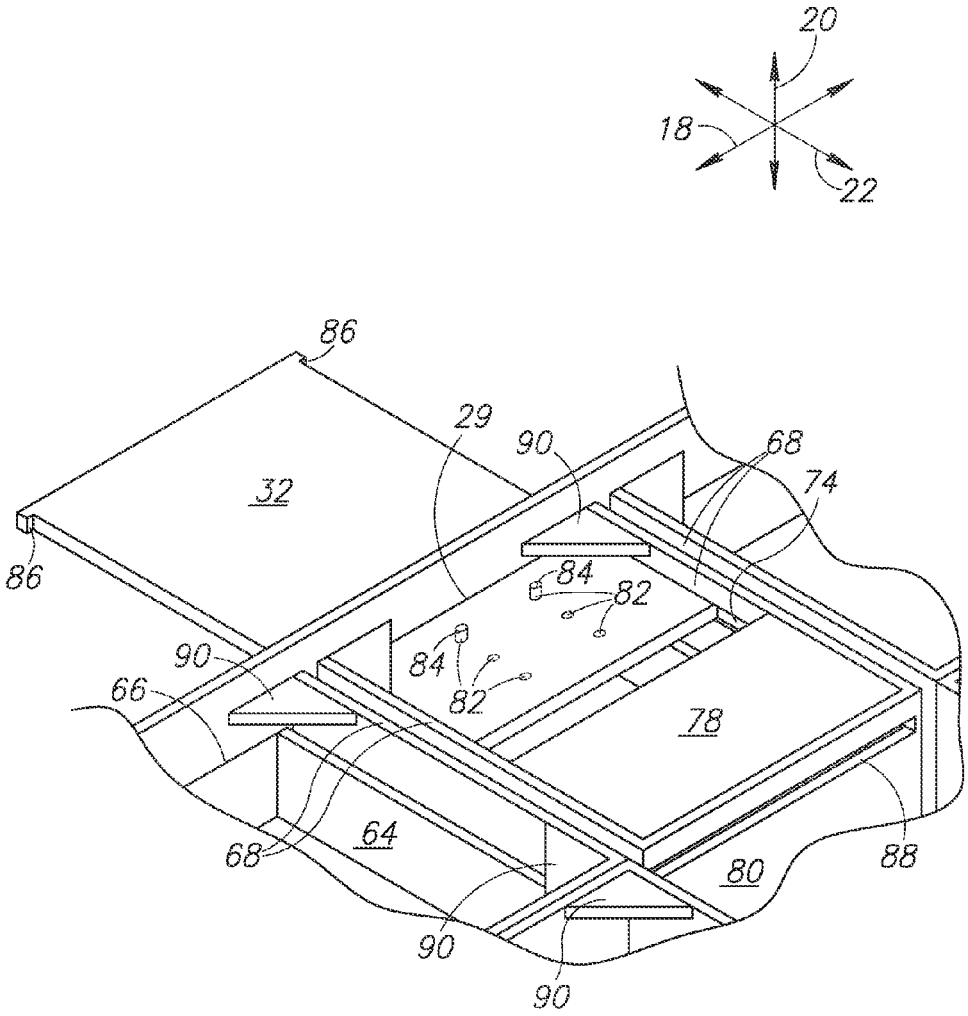
FIG. 4 is a partial isometric view of a slideout feature in accordance with an embodiment of the present invention.

Referring to FIG. 4, for example, the reinforcing panel 78 may extend between panels 68 and abut a back panel 80 of a module 62. The panels 68 and back panel 80 may be oriented vertically having the panels 68 extending from perpendicular from the back panel 80. The reinforcing panel 78 may therefore be flush with upper edges of the panels 68 and back panel 80 and secure to one or both of the panels 68 and back panel 80. As shown, the reinforcing panel 78 may only extend partially from the back panel 80 toward the panel 24, e.g. between 30 and 50 percent of the distance from the back panel 80 to the panel 24. However, in other embodiments, the reinforcing panel 78 may span a greater portion, such as the entire distance.

The slideout feature 32 may define one or more rows of apertures 82. The apertures 82 may be distributed in rows extending in the lateral direction 22. Pegs 84 or other structures may insert within the apertures 82 and function as stops to limit the extension of the slideout feature 32 out through the slots 29 of the panel 24. By moving the pegs 84 to a different pair of apertures 82, the amount of permissible extension may be adjusted. Similar apertures 82 and pegs 84 may also be provided for the slideout features 28. In some embodiments, a lip 86 may be defined at a distal end of the slideout feature 32 in order to limit insertion of the slideout feature 32 through the slot 29 of panel 24. A slideout feature 26 may have a similar lip 86. The lip 86 may be defined by protrusions extending laterally or vertically from a distal portion of the slideout feature 32. In some embodiments, the back panel 80 may define a slot 88 to permit the slideout feature 32 to extend there through when in a retracted position.

In some embodiments, the modules 62 may include braces 90, such as triangular pieces of wood, each secured to a back panel 80 and a side panel 68 in order to stiffen the module 62. In some embodiments, a brace 90 may also secure at one edge to a panel 68 and at another edge to the panel 24.

Figure 5:
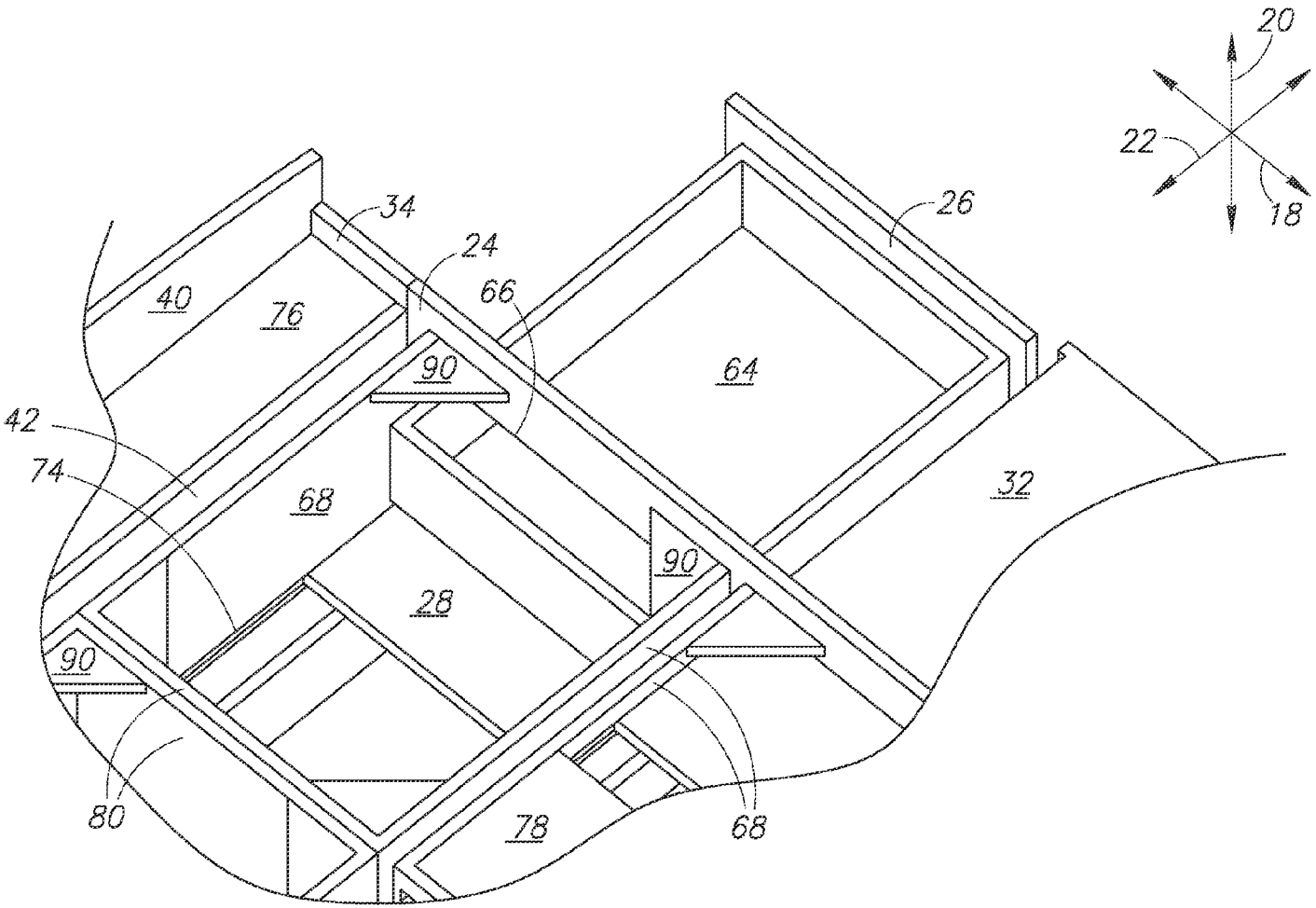
FIG. 5 is a partial isometric view of another slideout feature in accordance with an embodiment of the present invention.

Referring to FIG. 5, as discussed above, the slideout feature 28 may slide within grooves 74 (or grooves 72). The grooves 74 (or grooves 72) may be positioned vertically between drawers 64 and openings 66 for receiving drawers. A module 62 including a slideout feature 28 may likewise be reinforced by braces 90 having one edge secure to a back panel 80 and another edge secured to a panel 68. Likewise, a brace 90 may secure at one edge to a panel 68 and at another edge to the panel 24. In some embodiments, the panels 68 of longitudinally adjacent modules 62 may be secured to one another. Likewise, back panels 80 of laterally adjacent modules 62 may secure to one another in some embodiments. Securement may be accomplished using one or more of screws, nails, glue, and other fasteners.

Figure 6:
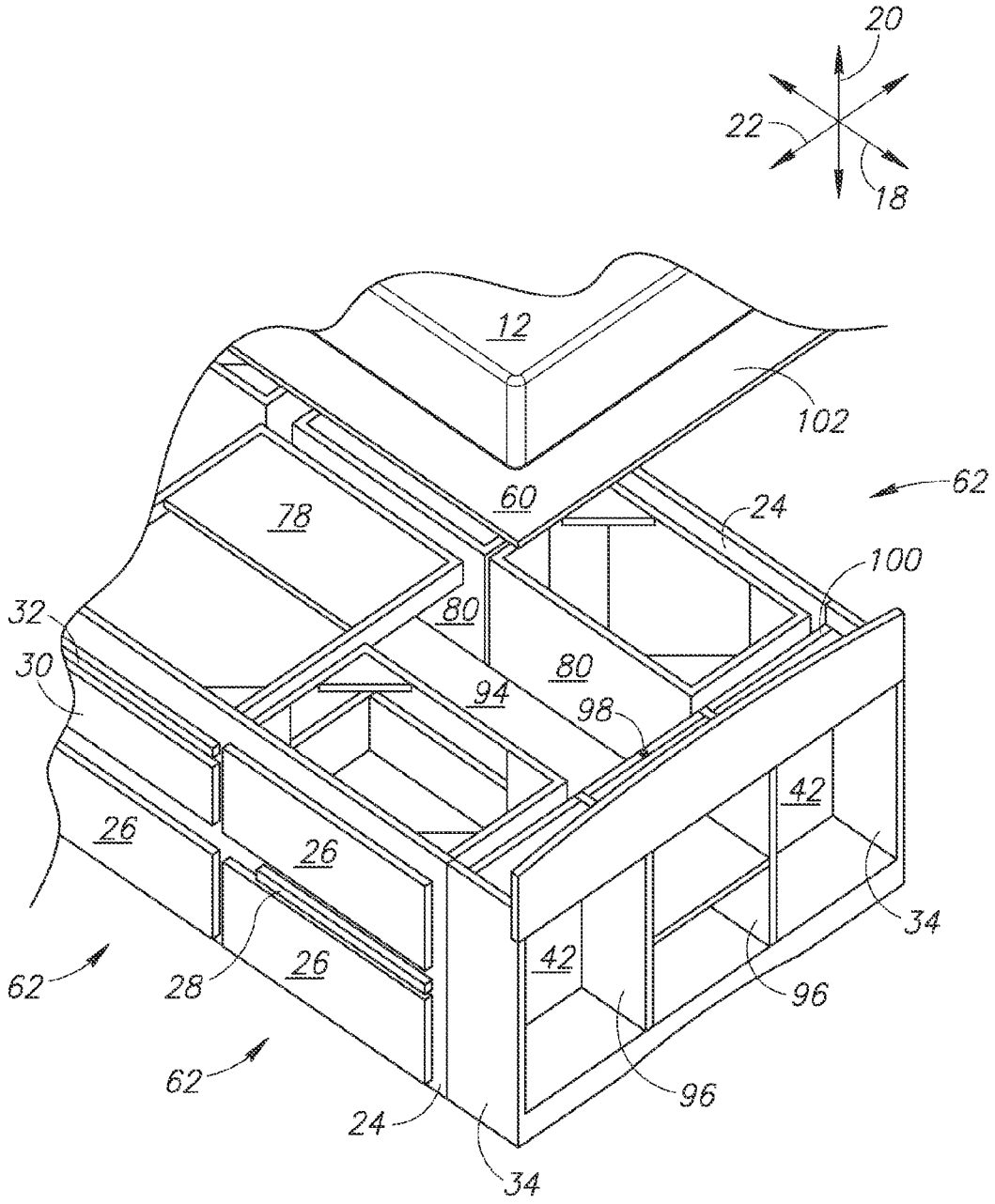
FIG. 6 is a partial isometric view of a bed including a slideout platform in accordance with an embodiment of the present invention.

Referring to FIG. 6, some embodiments may include a slideout platform 94, which may have a length equal to a major portion of the longitudinal extent of the bed 10, e.g., greater than 50%, greater than 70%, or greater than 90% of the longitudinal extent of the bed. In some embodiments, the platform 94 may be positioned between back panels 80 of modules 62 positioned laterally on either side of the platform 94. Alternatively, the platform 94 may be positioned between modules 62 and a panel 24. The platform 94 may provide a planar upper surface having an extent in the longitudinal and lateral directions 18, 22.

In some embodiments, a portion of the platform 94 may protrude into the longitudinal position of the second platform portion 16, i.e., between the vertical supports 34. For example, a pair of intermediate supports 96 may be positioned laterally between the vertical supports 34 and laterally offset from one another and the vertical supports 34. For example, the back panel 42 may include three fixed portions each extending between a support 34 and a support 96 or between the supports 96 below the platform 94 (not shown). An aperture 98 may be formed in a vertical panel 100 is secured to the platform 94 and is positioned to be flush with the fixed portions of the back panel 42 when the platform is in the retracted position shown in FIG. 6. A corresponding aperture 102 may be defined by the support panel 60.

Figure 7:
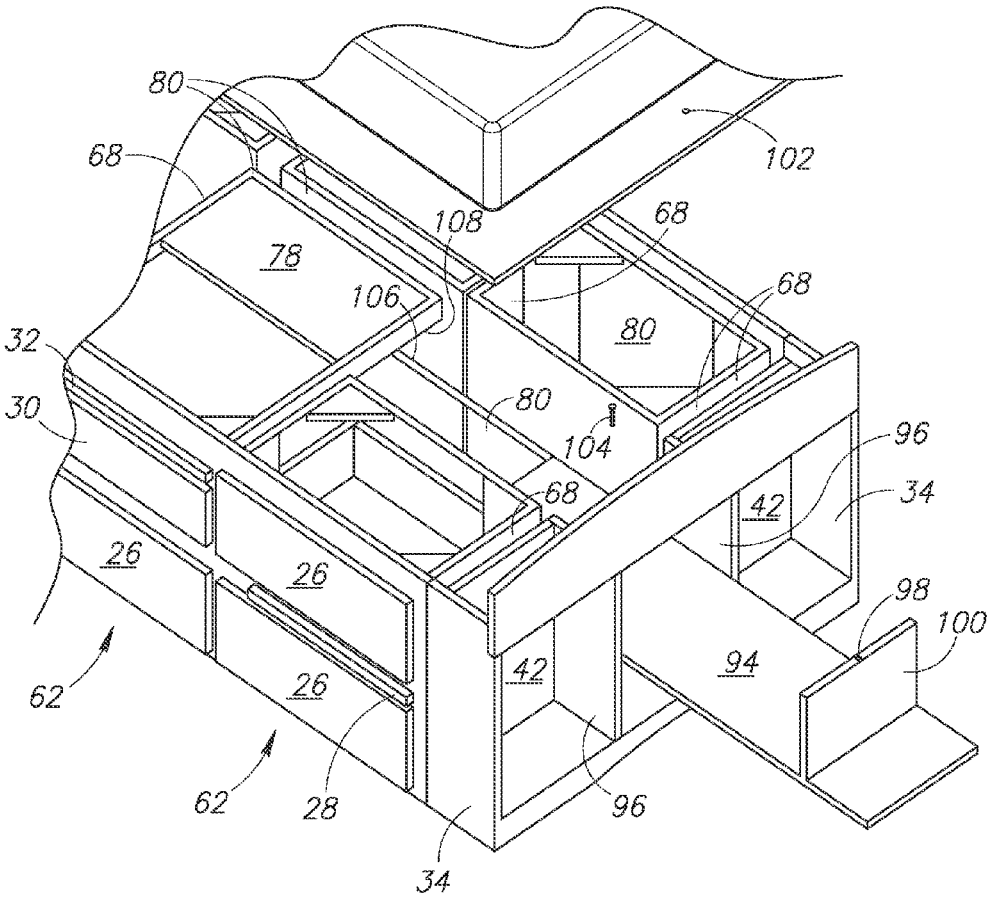
FIG. 7 is a partial isometric view of the bed of FIG. 6 having the platform in a deployed configuration in accordance with an embodiment of the present invention.

Referring to FIG. 7, in order to secure the vertical panel 100 a bolt 104, screw, or other fastener may insert through the aperture 102 and the aperture 98 in order to resist removal of the platform 94. The aperture 98 may be threaded to facilitate threaded engagement with the bolt 104. Upon removal of the bolt 104, the panel 94 may be slid out and objects placed thereon for storage. The platform 94 may then be slid into the retracted position of FIG. 6 and secured with the bolt 104 as noted. In some embodiments, one or more of the back panels 80 may define a groove 106 for receiving the platform 94. Alternatively, rails may be secured across the back panels 80, a lateral panel 24, or some other structure, and define the groove 106. Alternatively, any other mounting system such as rails and channels may be used to mount the platform 94 within the bed, such as to the back panels 80.

As shown in FIG. 7, the slideout feature 32 may protrude laterally across the lateral position of the platform 94 or the space for receiving the platform 94. In such embodiments, the panel 68 may include a cutout 108 to provide a space for the platform 94 and the objects placed therein. In the illustrated embodiment, the back panel 80 for the module 62 including the slideout feature 32 may likewise be intersected by the cutout 108 such that the back panel 80 also provides a vertical and lateral space for the platform 94 and objects placed thereon. In some embodiments, a door may hingedly secure to a panel secured across a foot of the bed 10 and the platform 94 may mount behind this door.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A bed comprising:

a first platform portion defining a longitudinal direction, a lateral direction perpendicular to the lateral direction and a vertical direction perpendicular to the longitudinal and lateral directions, the first platform portion defining a support area and lateral panels extending in a first direction from the support area parallel to the vertical direction, the lateral panels defining panel surfaces parallel to the vertical and longitudinal directions;

a second platform portion defining an upper surface, the upper surface being flush with the support area, the second platform portion including at least two vertical supports extending in the first direction from the upper surface, the at least two vertical supports each defining a support surface parallel to and flush with the panel surfaces; and at least one shelf extending parallel to the lateral direction between the vertical supports and offset from the upper surface in the first direction;

wherein the first and second platform portions are separate structures and are secured to one another by fasteners;

wherein the first platform portion defines one or more slots having a long dimension thereof oriented in the longitudinal direction, the one or more slots extending inward from one of the lateral panels in the lateral direction; and wherein the first platform portion defines a plurality of drawer receivers distributed in a row along the longitudinal direction, the plurality of drawer receivers including one or more first receivers having a first height in the longitudinal direction and one or more second receivers having a second height in the longitudinal direction, the second height being less than the first height, the one or more slots being positioned at least one of above and below the one or more second receivers in the vertical direction, the first height of the one or more first receivers spanning in the vertical direction both the one or more second receivers and the one or more slots.

2. The bed of claim 1, further comprising a platform cover extending over the upper surface of the second platform portion and the support area of the first platform portion.

3. The bed of claim 2, further comprising a mattress positioned on the platform cover, the mattress being supported by both the first and second platform portions.

4. The bed of claim 1, further comprising a headboard and a footboard, the headboard being coupled to the first platform portion and the footboard being coupled to the second platform portion such that the first and second platform portions are positioned between the headboard and the footboard.

5. The bed of claim 1, wherein the one or more slots are a plurality of slots, the plurality of slots including slots at different offsets in the first direction from the support area.

6. The bed of claim 1, further comprising one or more planar members positioned within the one or more slots.

7. The bed of claim 6, wherein each planar member has one or more stops secured thereto, the one or more stops of each planar member being positioned beneath the support area and sized to prevent passage of the one or more stops and the each planar members completely through a slot of the one or more slots in which the each planar member is positioned.

8. The bed of claim 7, wherein each of the planar members include a lip extending outwardly from the slot having the slot positioned between the lip and the one or more stops of the each planar member.

9. The bed of claim 6, wherein each of the planar members includes at least one row of holes distributed in the lateral direction, the one or more stops of the each planar member each comprising a post positionable within a hole of the at least one row of holes.

10. The bed of claim 6, wherein the first platform portion includes a plurality of modules, each module defining at least one slot and at least one drawer receiver.

11. The bed of claim 10, wherein each module includes two lateral planar members extending in the vertical and lateral directions, each lateral planar member defining a groove having a planar member of the one or more planar members positioned within the groove of the each lateral planar member.

12. The bed of claim 11, wherein each module includes a back panel extending in the vertical and longitudinal directions, the back panel secured to and extending between the two lateral planar members of the each module.

13. A bed comprising:

a first platform portion defining a longitudinal direction, a lateral direction perpendicular to the lateral direction and a vertical direction perpendicular to the longitudinal and lateral directions, the first platform portion defining a support area and lateral panels extending in a first direction from the support area parallel to the vertical direction, the lateral panels defining panel surfaces parallel to the vertical and longitudinal directions;

a second platform portion defining an upper surface, the upper surface being flush with the support area, the second platform portion including at least two vertical supports extending in the first direction from the upper surface, the at least two vertical supports each defining a support surface parallel to and flush with the panel surfaces; and at least one shelf extending parallel to the lateral direction between the vertical supports and offset from the upper surface in the first direction;

wherein the first and second platform portions are separate structures and are secured to one another by fasteners;

wherein the first platform portion defines one or more slots having a long dimension thereof oriented in the longitudinal direction, the one or more slots extending inward from one of the lateral panels in the lateral direction;

wherein one or more planar members are positioned within the one or more slots;

wherein the first platform portion includes a plurality of modules, each module defining at least one slot and at least one drawer receiver;

wherein each module includes two lateral planar members extending in the vertical and lateral directions, each lateral planar member defining a groove having a planar member of the one or more planar members positioned within the groove of the each lateral planar member; and wherein at least one of the modules includes a reinforcing member secured to and extending between the two lateral planar members, the reinforcing member being flush with upper edges of the two lateral planar members and laterally overlapping at least a portion of the grooves of the two lateral planar members.

14. The bed of claim 13, wherein the reinforcing member abuts a back panel extends in the vertical and longitudinal directions, the reinforcing member secured to and extending between the two lateral planar members.

15. A bed comprising:

a first platform portion defining a longitudinal direction, a lateral direction perpendicular to the lateral direction and a vertical direction perpendicular to the longitudinal and lateral directions, the first platform portion defining a support area and lateral panels extending in a first direction from the support area parallel to the vertical direction, the lateral panels defining panel surfaces parallel to the vertical and longitudinal directions;

a second platform portion defining an upper surface, the upper surface being flush with the support area, the second platform portion including at least two vertical supports extending in the first direction from the upper surface, the at least two vertical supports each defining a support surface parallel to and flush with the panel surfaces; and at least one shelf extending parallel to the lateral direction between the vertical supports and offset from the upper surface in the first direction;

wherein the first and second platform portions are separate structures and are secured to one another by fasteners;

wherein the first platform portion defines one or more slots having a long dimension thereof oriented in the longitudinal direction, the one or more slots extending inward from one of the lateral panels in the lateral direction;

wherein one or more planar members are positioned within the one or more slots;

wherein the first platform portion includes a plurality of modules, each module defining at least one slot and at least one drawer receiver;

wherein the modules are arranged in two rows extending in the longitudinal direction, the two rows defining a lateral space therebetween; and wherein a platform defining a planar surface extending in the longitudinal and lateral directions, the platform slidingly mounted between the two rows.

* * * * *